United States Patent [19]

Corteville et al.

[11] Patent Number: 4,860,825

[45] Date of Patent: Aug. 29, 1989

[54] DEVICE FOR POSITIONING A TOOL OR INSTRUMENT IN A DUCT

[75] Inventors: Jacques Corteville, Rueil Malmaison; André Pauc, Villennes sur Seine; Frédéric Hoffmann, Courbevoie, all of France

[73] Assignee: Institut Francais du Petrole, Rueil Malmaison, France

[21] Appl. No.: 304,601

[22] Filed: Feb. 1, 1989

Related U.S. Application Data

[63] Continuation of Ser. No. 829,188, Feb. 14, 1986, abandoned.

[30] Foreign Application Priority Data

Feb. 14, 1985 [FR] France ..... 85 02285

[51] Int. Cl.[4] ..... E21B 23/08; E21B 43/18

[52] U.S. Cl. ..... 166/68; 166/72; 166/105; 166/153; 166/155; 417/172

[58] Field of Search ..... 166/68, 70, 72, 105, 166/106, 153, 155, 156, 372, 383; 417/172

[56] References Cited

U.S. PATENT DOCUMENTS

| | | | |
|---|---|---|---|
| 3,070,167 | 12/1962 | Loy, III et al. | 166/153 |
| 3,104,714 | 9/1963 | Terrell et al. | 166/155 |
| 3,530,935 | 9/1970 | Garrett | 166/153 |
| 3,543,852 | 12/1970 | Taylor | 166/155 |
| 4,293,283 | 10/1981 | Roeder | 417/172 |
| 4,605,069 | 8/1986 | McClayflin et al. | 166/310 |

FOREIGN PATENT DOCUMENTS 2107397 4/1983 United Kingdom .

*Primary Examiner*—Hoang C. Dang

*Attorney, Agent, or Firm*—Antonelli, Terry & Wands

[57] ABSTRACT

A device for positioning a tool or instrument in a duct and recovering the tool or instrument therefrom by causing a vector fluid to flow through the device. The device includes a tubular element adapted to be connected to the tool or instrument and an annular sealing arrangement mounted on the tubular element for sealing the tubular element in the duct. The tubular element includes an arrangement for selecting a direction of movement of the tool or instrument which includes a closing device for cooperating with a resilient conjugate piece and a device for reversing a direction of movement of the closing device. The cooperation of the closing device with the resilient conjugate piece occurs in at least three states. In the first state, the fluid flows through the tubular element in a first direction; in the second state, the fluid flow is stopped in a direction opposite to the first direction of fluid flow; and, in the third state, the fluid is stopped in the first direction. The reversal device is adapted for holding the closure device either in the first and second state while excluding the third state, or in the third state.

41 Claims, 4 Drawing Sheets

DEVICE FOR POSITIONING A TOOL OR INSTRUMENT IN A DUCT

This is a continuation of application No. 829,188, filed Feb. 14, 1986, now abandoned.

BACKGROUND OF THE INVENTION

The present invention relates to a device for positioning a tool or instrument in a duct and recovering it by causing a vector fluid to flow, usable more particularly for working self contained hydraulic pumps at the bottom of wells, in production through the inside of production tubing.

The invention relates particularly to positioning and recovering self contained tools at the bottom of water or hydrocarbon producing wells.

This technique is more particularly interesting in the case of independent well bottom hydraulic pumps, and in particular, hydraulic pumps of the jet pump type, when the production is brought to the surface by production tubing. It is the example which has been chosen here for describing the invention, but is also applies to all equipment which may be useful for carrying out tests, regulations, measurements and for safety purposes at the bottom of the wells in particular pressure, temperature of flow rate recorders which can be operated in this way, alone or associated with self contained pumps.

The invention also applies to gas producing wells and to wells activated by gas-lift.

Hydraulic well bottom pumping assemblies and, particularly, jet pumps are relatively compact. Their weight and size are sufficiently reduced to allow them generally to be installed and moved inside a production tubing. These pumps are very often simply placed on a receptacle from which they may be readily separated. They may then be considered as free, for they may be rapidly placed in position or removed from the well by a hydraulic flow or by wire-line working. With respect to the other non free activation systems (rod pump, conventional electric pumps), maintenance thereof is therefore simpler, more rapid and less expensive.

The technique the most generally used consists of feeding the free hydraulic pumps with a drive fluid injected in the production tubing. The production is then raised through the annular space between this production tubing and the casing. In some cases, raising the production may take place through another production tubing, if a double completion is provided.

In the case of production through the annular space, the drive pressure in the production tubing allows the pump to be applied and maintained in its housing at the bottom of the well. To raise the pump, the flow of the fluids is reversed. A valve placed at the delivery side of the pump allows the pressure necessary for its movement to be maintained downstream thereof.

Production through the annular space presents risks in the following situations, which occur relatively frequently: namely, corrosive fluids (crude and water from the field), in particular when they contain sulphurated hydrogen or carbonic gas, abrasive fluids, when production takes along with it sand from the formation, and fluids which form paraffin, asphalt or salt deposits. The production of such fluids may cause damage to the tubes, namely, production tubing and casing, and a clogging of the annular space.

Moreover, the geometry of the annular space is not well defined, and the production tubing being positioned in an irregular manner does not allow the flow of fluids produced to be readily calculated whereby deposits are formed in the zones of lower flow rates and, in particular, at the contact points between the production tubing and the casing.

The present invention overcomes these disadvantages by allowing production through the production tubing. With this method, the drive fluid, which is preferably a fluid suitably treated to prevent risks of corrosion, abrasion and deposits, is injected into the annular space.

The pumped fluid mixed with the drive fluid, is raised to the surface through the inside of the production tubing where corrosion, erosion and deposit phenomena may be more readily controlled and treated.

Possible damage by the fluids produced is thus limited to the inside of the production tubing, which tubing is of a smaller diameter. The repairs which concern solely the production tubing and not the assembly of this tubing and the casing are therefore more rapidly executed and are less costly and the safety of the well better ensured in the case of a breakdown.

Conventional techniques may be applied for positioning and removing a well bottom hydraulic pump with production through the production tubing. Techniques using wire-line working and a pumped auxiliary tool have been proposed in the patent GB-A-No. 2 107 397 in relation with hydraulic jet pumps. However, these proposed techniques seem relatively time consuming to put into practice and require complementary tools.

Other prior art techniques of operating with fluid flow are illustrated, for example, by the patents U.S. Pat. Nos. 3,395,759, 3,543,852, 4,360,063, 3,229,785 and 3,789,925.

The essential purpose of the present invention is to provide a device for positioning a tool or an instrument in a duct and recovering it. It may be used, more particularly, for stimulating the production of an oil well by allowing a self contained hydraulic pump to be placed at the bottom of the well, with the pump may allow production through the inside of production tubing.

With the device of the invention, it will be possible to overcome the drawbacks of the prior art such as described in, for example, U.S. Pat. No. 3,530,935.

SUMMARY OF THE INVENTION

The present invention provides a compact device of simple construction, and more, especially, of greater reliability, which in particular considerably reduces the manufacturing and production costs.

More precisely, the device of the invention allow a tool or instrument to be placed in a given working position inside a duct, then to be recovered by causing a vector fluid to flow, with a device comprising a tubular element adaptable to the tool or instrument and annular sealing means.

In accordance with the present invention, the tubular element contains means for selecting the direction of movement of the tool or instrument which comprise in combination closure means comprising a closing device cooperating with a conjugate piece and a device for selecting the direction of movement, with the conjugate piece comprising at least one sealing surface, the closure means having has least three states, in the first state, the closing device cooperating with the conjugate piece to allow the fluid to pass in a first direction; in the second state, the closing device cooperating with the conjugate piece to prevent the passage of fluid in the direction opposite to first direction, and, in the third state, the closing device cooperating with the conjugate piece to prevent the passage of fluid in the first direction, the selection device is adapted to assign the closure means either to said first two states while excluding the third one, or to said third state.

The conjugate piece may comprise at least one other sealing surface and the closure means may have at least three positions, the first position corresponding to the first state, the second position corresponding to the second state where the closing device cooperates with the surface, the third position corresponding to the first state where the closing device cooperates with the other surface.

The device may comprise means for remote controlling said reversal device. The remote control means may comprise resilient and/or plastic means adapted for allowing movement of the closing device relatively to the conjugate piece only from a force of predetermined intensity.

The device may comprise pumping means capable of acting on the closing device.

The reverse device may be adapted for assigning to the closure means either the first two states while excluding the third state, or the third state while preventing return to the first two states.

The device may comprise a locking device and the tubular element may cause engagement and/or disengagement of the locking device form the tubular element assembly, tool or instrument in the duct.

The device for reversing the direction of movement may form an integral part either of the closing device or of the conjugate piece.

The closure means may comprise, in combination, a closing device such as a ball and a member for reversing the direction of movement, with the member being hollow and having an orifice separating the external and internal walls which form the sealing surfaces for the closure element, and with the member being able to move axially in the tubular element under the effect of an over pressure, against the action of means for returning from the second position, where the orifice is closed by the closing device, to the third position where the diameter of the orifice is increased and allows the closure element to pass.

The member may comprise an assembly of coaxial blades which, by moving away from each other, allow an increase in a diameter of the orifice.

The internal wall of the tubular element may comprise a projection slanted with respect to the axis of the tubular element against which the member bears at its upper part under the action of the return means.

An annular element or pusher may be inserted between the member and the resilient return means, this pusher being connected to the tubular element by at least one safety element such as, for example, a shear-pin.

A jet pump, which may be placed in a duct equipping a well whose production is activated by injecting a drive fluid from the surface into the annular space between the duct and the wall of the well, may be equipped with a device as defined before permitting this pump to be placed in a working position in the duct from the surface then to be recovered from the surface.

The invention has more especially allowed a self contained hydraulic pump assembly to be perfected the positioning and withdrawal of which is effected by simply reversing the fluid flow. This assembly may be moved in all directions inside the production tubing at a speed of the order of a meter per second.

Thus, for a well of a depth of 1500 m, the operation for starting up production may take place in less than an hour. During the positioning and raising of the pump, its position may be perfectly well determined at all times, knowing the flow rate of the fluid injected for moving it. No additional equipment with respect to the production mode through the annular space is required at the surface for carrying out these operations.

The use of this technique is compatible to that of wire line working. Tools suspended from the cable may effect positioning of the well bottom equipment, anchorage and withdrawal of the positioning tool. Other tools using, for example, the spudding technique, may allow the well bottom equipment to be withdrawn in particular in the case of the breakdown in the hydraulic flow circuit.

Examples of embodiment of this system are described hereafter in detail for a hydraulic jet pump, but they also apply to other well bottom apparatus capable of being positioned by hydraulic pumping.

BRIEF DESCRIPTION OF THE DRAWINGS

The description of these examples refers to the accompanying drawings wherein.

DESCRIPTION OF THE PREFERRED EMBODIMENTS

Figure 1:
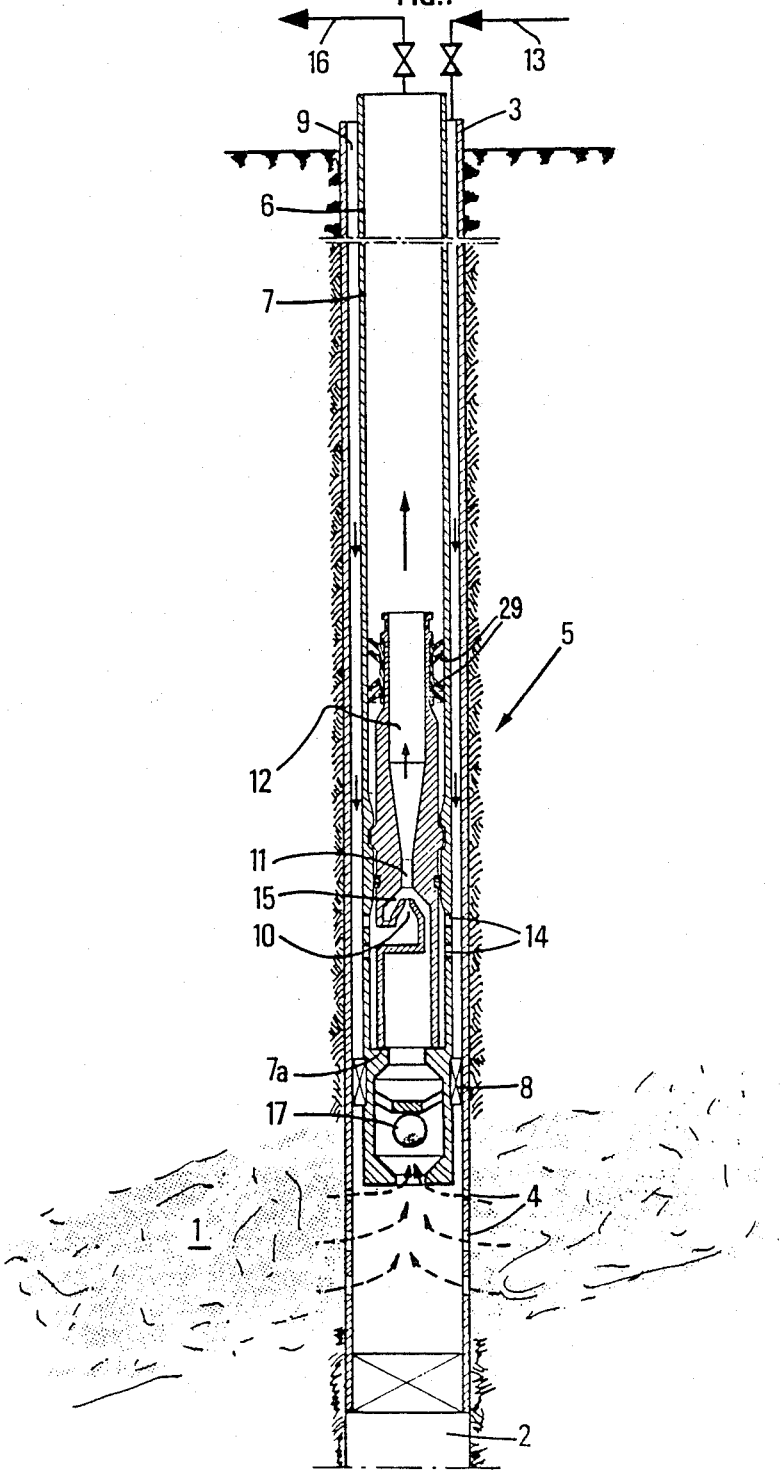
FIG. 1 in a particularly schematically longitudinal cross-sectional view of a geological producer formation depicting a method of production through the inside of the production tubing, using a jet pump.

Referring now to the drawings wherein like reference numerals are used throughout the various views to designate like parts and, more particularly, to FIG. 1, according to this figure, a geological producer formation 1 has a well 2 drilled therein, with the well 2 being equipped with a casing 3 including perforations 4 at the level of the productive layer.

The production is activated by a jet pump generally designated by the reference numeral 5. The jet pump 5 is installed freely in the production tubing 6 disposed inside the casing 3. By "free" pump is meant here a pump which may move in the production tubing 6 and which, during operation, rests on a shoulder 7*a* formed in the receiving tubing 7, integral with the production tubing 6.

A sealing device 8 of the packer type surrounding the receiving tube 7 isolates the oil bearing layer from the annular space 9 between the production tubing 6 and the casing 3.

The jet pump 5 comprises essentially a nozzle 10 over which is mounted a mixer 11 and diffuser 12 assembly. Activation of the production is achieved by injecting a drive fluid 13 from the surface into the annular space 9. This fluid penetrates into nozzle 10 through side orifices 14 formed in the receiver tube 7 (the flow of this fluid is shown by the continuous line arrows).

The restriction of the passage section for the drive fluid through nozzle 10 forms a high speed jet. This jet causes a depression which allows the fluid to be pumped to the base of tubing 7 to be sucked up and driven through the neck 15. The flow of the fluid to be pumped is shown with broken lines. The two fluids are combined in the mixer 11. The diffuser 12 transforms the kinetic energy acquired by the fluids into pressure.

The pressure gain thus obtained provides the power required for raising the production as far as 16 at the surface. A bottom valve 17 disposed under the jet pump 5 prevents the pumped fluid from returning to the oil bearing layer.

Figure 2:
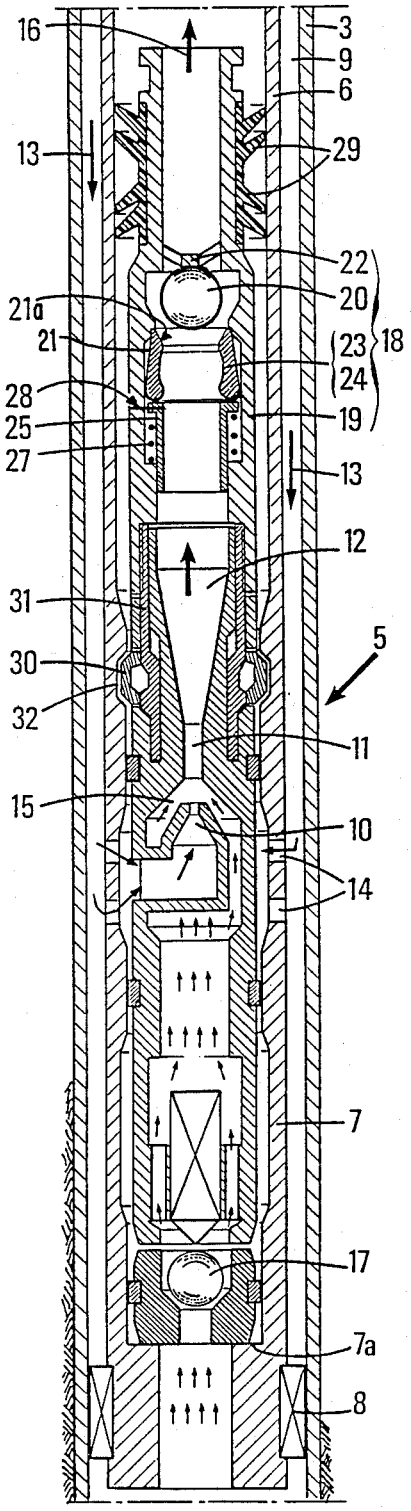
FIG. 2 is a partial axial cross-sectional view of a jet pump equipped with a mechanism in accordance with the invention which makes the pump self contained.

FIG. 2 shows the whole of pump 5 with the original positioning and removing mechanism of the invention. This mechanism is articulated about selection means such as a selective valve 18 permitting the direction of movement of the pump in production tubing 6 and receiving tubing 7 to be selected, with the selective valve 18 being housing in the tubular element 19 integral with pump 5.

The selective valve 18 is formed by closing device such as a ball 20 or any other closing device, retained between a sealing surface 21 placed on the conjugate piece 24 and a top stop 22. The position of the closing device relative to the conjugate piece 24 permits or prevents the flow of the fluid through the pump 5.

Figure 2B:
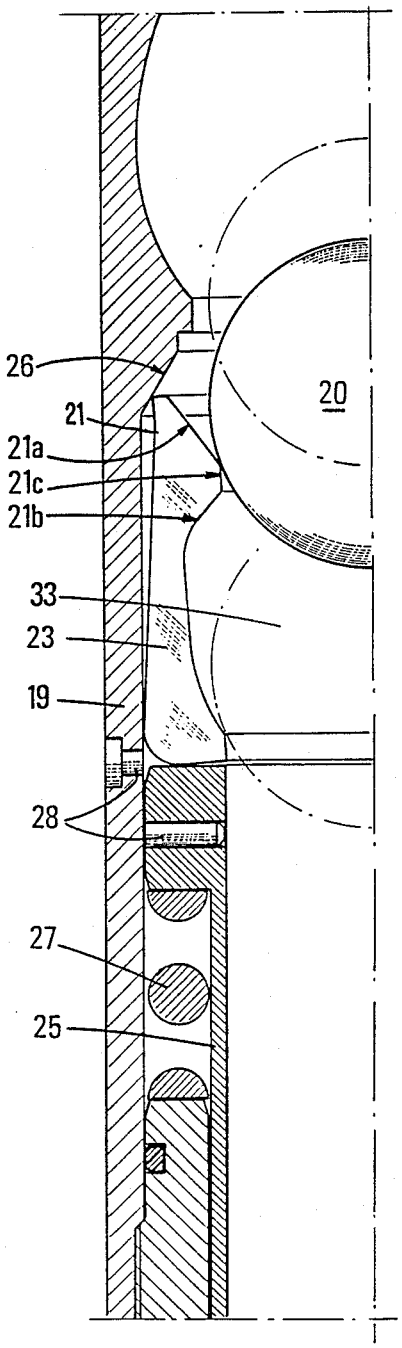
FIG. 2*b* and 2*c* are cross-sectional detail view depicting the positioning of the ball of the valve for raising the pump.
Figure 3:
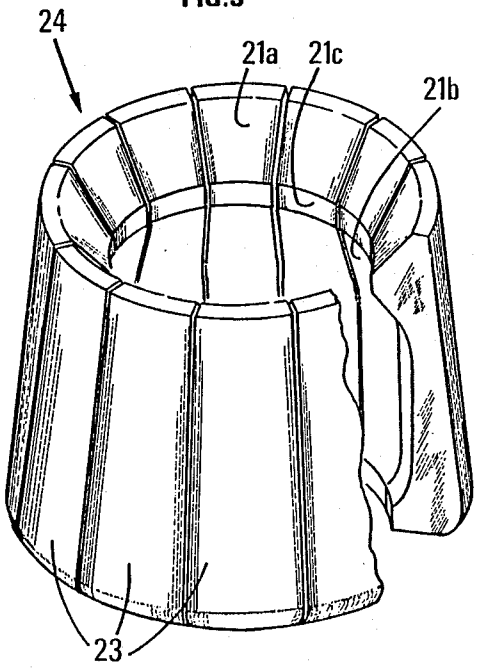
FIG. 3 is a perspective view of the conjugate piece selective of the direction of movement illustrated in FIG. 2.

The conjugate piece 24 for reversing the direction of movement comprises several pieces or jointing blades 23 disposed like a corolla which form, as shown in FIG. 3, a hollow coaxial assembly held in position by a pusher 25 (FIGS. 2A–2C) against a conical bearing surface 26 (FIGS. 2B–2D) or, more generally, a bearing surface slanted with respect to the axis of the tubular element 19, with the pusher is urged by a spring 27.

One (or more) safety elements 28 such as, for example, a pin (FIG. 2A–2C) calculated to break under a given force, or other simple mechanisms, comprising, for example, a calibrated spring, ensures the reliability of the assembly while preventing accidental opening of the system. An annular seal 29 (FIG. 2, 2A, 2C, 2D) placed above the valve completes the assembly.

The role of the selective valve system is to transform the pressure available in the production tubing 6 into a force acting on the pump 5 so as to cause movement thereof during positioning and removal operations, while letting the fluid pass freely, during the phase of pumping the production fluid illustrated in FIG. 2.

OPERATIONS FOR POSITIONING AND REMOVING THE PUMP:

1. Lowering the pump (FIG. 2*a*)

Figure 2D:
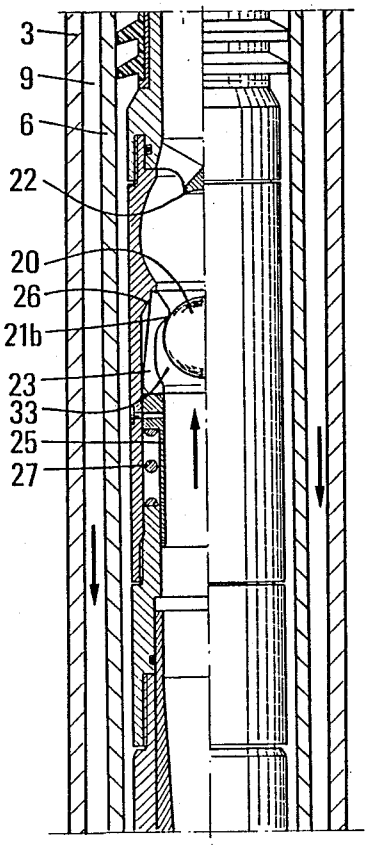
FIG. 2*d* is a cross-sectional detail view depicting the device in the position for raising the pump.
Figure 2C:
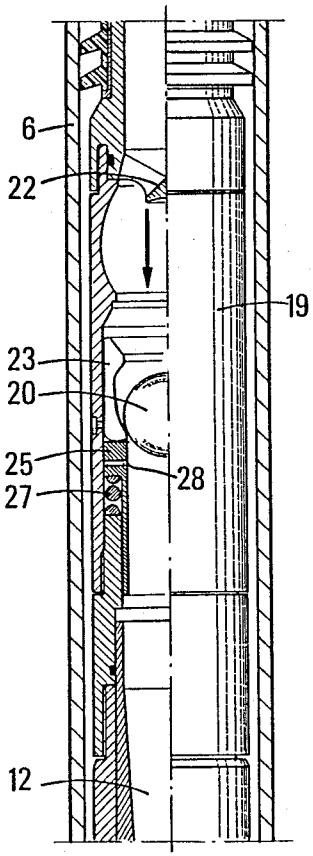
Figure 2A:
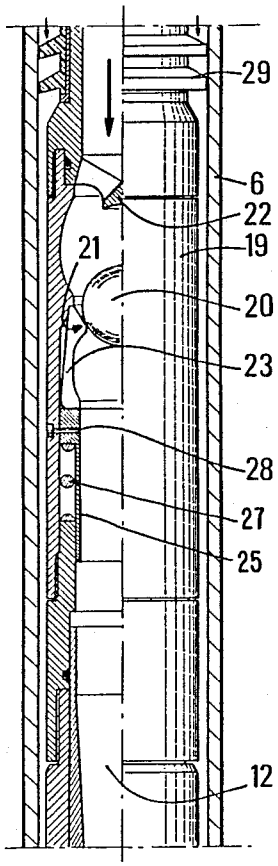
FIG. 2*a* in a cross-sectional detail view, on an enlarged scale depicting the position of the mechanism during lowering of the pump into the production tubing.

The ball 20 is placed in the position shown in FIG. 2A. In this position of the member or coaxial assembly 24, the ball 20 cannot pass through the upper orifice 21*c* of this member whose passage section is insufficient. On each side of the orifice 21*c*, the walls of the pieces or blades 23 are arranged so as to form an external sealing surface 21*a* and an internal sealing surface 21*b*, respectively, for the ball 20 in this close-up position of the pieces or blades 23. As a matter of fact, the blades 23 cannot move apart from each other, since they are held in contact with the conical bearing surface 26 by the spring 27 and the safety elements 28.

The injection of pressurized fluid at 16 into the production tube 6 creates a pressure which exerts a vertical downward force on pump 5, with the fluid not being able to flow therethrough. This force is sufficient to drive the pump 5 to its anchorage position. Locking of the pump 5 is provided by locking "dogs" 30 (FIG. 2), integral with sliding linars 31, in the corresponding recesses 32 of the production tubing 6 when the self contained assembly, tubular element, tool or instrument has been positioned by a location module such as a stop or a key device well known in the art. The differential pressures may, for example, be 20 bars for lowering of the pump 5 and 40 bars for locking the pump 5.

2. Pump during production (FIG. 2)

The injection of the drive fluid 13 into the annular space 9 pushes the ball 20 to the top stop 22, which allows the well to be activated while producing the fluids following the path shown by the arrows.

3. Recovery of the pump (FIGS. 2B, 2D)

Once the production has stopped, the flow of fluid is reversed, that is to say that the pressurized fluid is injected into the production tubing 6 from the surface and the ball 20 comes back onto the sealing surface 21*a*. A relatively high over pressure of, for example, 80 bars, generates a sufficient force for overriding the safety element 28 (shearing of the pin). The force compresses the spring 27, the conjugate piece 24 reversing the direction of movement is pushed downwards, as shown in FIG. 2B. The blades 23, forming the sealing surface 21*a*, move apart and permit the ball 20 to pass which engages in its new housing 33 (FIG. 2*zb*) inside the conjugate piece 24. Stopping of the injection balances the pressures in the production tubing 6, overriding the force acting on the selective valve 18, whereby; the spring 27 then resumes its initial position and ball 20 is imprisoned in housing 33 (FIG. 2C).

After reversal of the flow of the fluid (injection of the fluid through the annular space 9), the ball 20 comes into abutment on its new internal sealing surface 21*b* (FIG. 2D), stopping the passage of the fluid. The rise of the pressure in pump 5 establishes a rising force which causes the pump 5 to be unlocked and to be raised in the production tubing 6.

Figure 4:
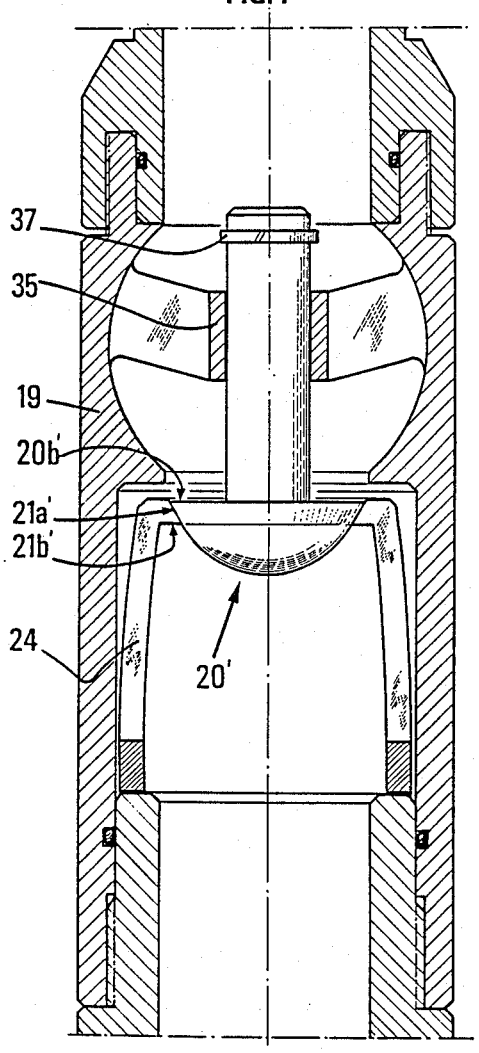
FIG. 4 in a cross-sectional detail view on an enlarged scale, of a first modification of the device of the present invention.

FIG. 4 shows the detail of a second device for selecting the direction of movement in accordance with the invention which is housed in a tubular element 19 integral with pump 5, as in the preceding description of FIG. 2.

The means for selecting the direction of movement are formed of a closing device 20' movable axially through a guide stop 35 from a position defined by the guide stop 35 to a position in which the closing device 20' is in contact with the sealing surface 21*a'* of the conjugate piece 24'.

Figure 4A:
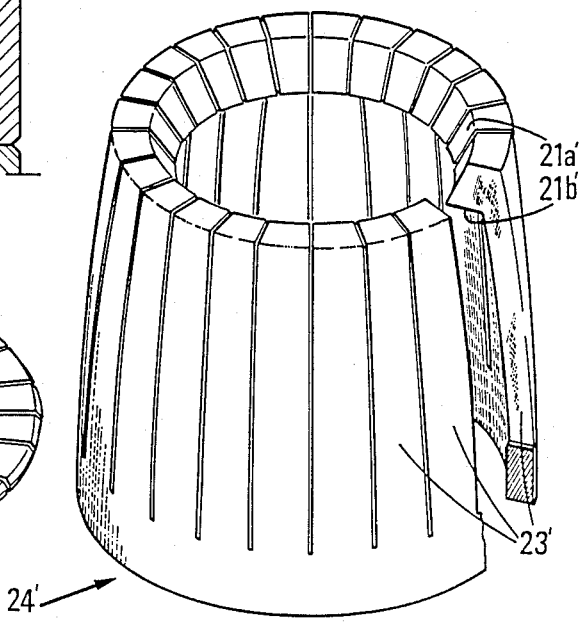
FIG. 4*a* is a perspective view of the conjugate piece selective of the direction of movement shown in FIG. 4.

The conjugate piece 24' is formed of jointing blades 23' disposed in the form of a corolla and all connected at their base, as shown in FIG. 4A. The blades 23' having a resilience such that they only allow the closing device 20' to pass, from a certain hydraulic pressure exerted on its closing device 20'.

It is also possible to adjust the predetermined pressure for passage of the closing device 20' through the conjugate piece 24', not only because of the resilience of the conjugate piece 24', but also because of the shearable safety elements placed athwart the axis of the closing device and bearing against the guide stop 35 for shearing themselves.

By reversing the direction of fluid flow and by providing the predetermined over pressure required for assigning the third stage to the closure means, the closing device 20' comes into position facing the sealing surface 21*b'* while being no longer able to resume its prior position. This may be achieved, more especially, by forming the sealing surfaces 20*b'* and 22*b'* substantially perpendicular to the direction of movement of the closing device as is shown in FIG. 4.

OPERATING PRINCIPLE:

1. Lowering the assembly

The closing device 20' comes to bear against the sealing surface 21*a'* for providing sealing and allowing lowering of the tubular element and tool or instrument assembly under the action of the pumping means which produce a downward axial force on the assembly. Locking is then effected as mentioned above in the description of FIG. 2A.

2. Pump under production

The injection of drive fluid into the annular space 9 pushes the closing device 20' towards the guide stop 35, which allows the well to be activated while producing the fluids as described hereinabove.

3. Recovery of the pump

With the reversal of the flow direction of the fluid, the closing device 20' comes to bear on the sealing surface 21*a'*. Because of a relatively high overpressure applied to the closing device 20', the closing device 20' opens the conjugate piece 24' and/or shears the safety element and penetrates inside to be there imprisoned. A retaining device 37 prevents the closing device 20' from being lowered further.

After reversal of the fluid flow (injection through the annular space 9) the closing device 20' is applied against the sealing surface 21*b'*, stopping passage of the fluid. The rise of the pressure in pump 5 creates a rising force which allows the pump 5 to be unlocked and to be raised in the production tubing 6.

The sealing surface 21*b'* is formed such that, when the closing device 20' is applied there against, while exerting an axial force directed towards the upper part of FIG. 4, the blades 23 do not move apart.

In the case of FIG. 4, the sealing surface 21*b'* and the surface 20*b* of the part of the closing device 20' which cooperates therewith, a perpendicular to the direction of movement of the closing device 20'.

Figure 5:
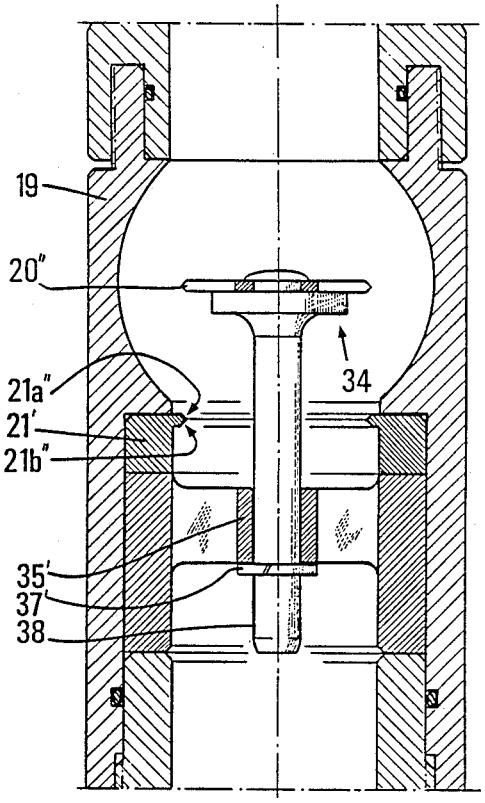
FIG. 5 is a cross-sectional detail view, on an enlarged scale, of a second modification of the device of the invention.

FIG. 5 shows a detail of a third embodiment of the means for selecting the direction of movement in accordance with the invention which is housed in the tubular element 19 integral with pump 5 as in the preceding description of the first device.

The means for selecting the direction of movement are formed of a closing device 20'' movable axially by a guide stop 35 from a positioned defined by the travel limiter 37' to a position in which the closing device 20' is in contact with the sealing surface 21*a''* of the conjugate piece 21'.

The conjugate piece 21' comprising two surfaces 21*a''* and 21*b''* which may engage with the closing device 20'' for providing sealing.

Figure 5A:
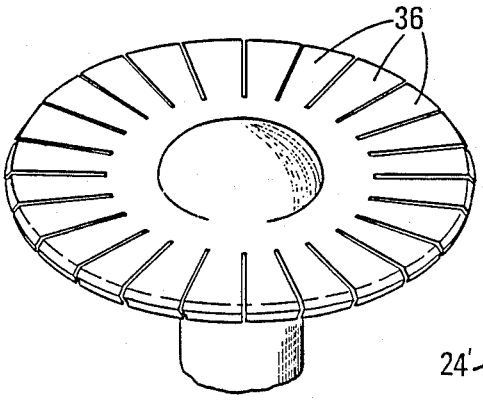
FIG. 5*a* is a perspective view of the closing device shown in FIG. 5.

As shown in FIG. 5A, closing device 20'' is formed of radial blades 36 connected at their center and integral with the shaft 38, with a thickness, width and length of the radial blades 36 being adjusted so as to provide the resilience required for allowing the closing device 20'' to pass through the conjugate piece 21', under the effect of a predetermined over pressure applied when the closing device 20'' bears against surface 21*a''*.

Piece 34 which is not integrated with the closing device 20'' but with the shaft 34 selectively rigidifies the closing device and thus prevents any disengagement of the closing device 20'' when it bears against surface 21*b''*.

OPERATION

1. Lowering the assembly

The injection of pressurized fluid 16 into the production tubing 6 creates a pressure which exerts a vertical downward force on pump 5, since the fluid cannot flow therethrough because the closing device 20'' is in contact with surface 21*a''* and provides sealing.

This force is sufficient to drive pump 5 as far as its anchorage position.

Locking of the assembly takes place as described hereinabove.

2. Pump under production

The injection of drive fluid into the annular space 9 pushes the closing device 20'' in abutment because of the course limiter 37, which allows the well to be activated while producing the fluids through the production tubing 7.

3. Removal of the pump

When production is stopped, the closing device comes to rest again on the sealing surface 21*a''*.

Under the effect of a relatively high over pressure, the blades 36 of the closing device 20'' are deformed and allow the closing device 20'' to pass through the conjugate piece 21'. In this position, the injection of fluid through the annular space 9 applies the closing device 20'' against the sealing surface 21*b''* and thus produces a vertical rising thrust for unlocking and raising the pump 5 in the production tubing.

In the embodiment of FIGS. 5, 5A, with a device for reversing the direction of movement which does not form an integral part either of the closing device 20'' or of the conjugate piece 21'', such as electrically or pneumatically remote controlled dogs, etc . . . , it is readily conceivable that surface 21*a''* is the only surface providing sealing, on the one hand, during the injection of fluid through the production tubing 6 for lowering the pump 5 and, on the other hand, during the injection of fluid through the annular space 9 for removing the pump 5.

In this latter case, the dogs are actuated, whereas, the closing device 20″ is in abutment against the sealing surface 21*a*″They maintain the closing device 20″ substantially in this position. A sufficient pressurization of the annular space 9 then causes removal of the pump 5. Thus, surface 21*b*″ would become useless and could be omitted.

Such a possibility of construction is readily transposable to the other previously described embodiments.

Without departing from the scope of the present invention, the tubular element may comprise several pieces connected together by at least one articulation.

What is claimed is:

1. A device for enabling a positioning of a tool or instrument in a given working position inside a duct and for enabling a recovery of the tool or instrument by causing fluid to flow through the device, the device comprising a tubular element adapted to be connected to the tool or instrument, and an annular sealing means mounted on the tubular element for sealing engagement with the duct, wherein said tubular element comprises means for selecting the direction of movement of the tool or instrument in said duct, said selecting means including an annular member disposed in said tubular element, a closure means displaceably mounted in said tubular member, and means for enabling a reversing of a direction of movement of said tubular element in said duct, said annular member including at least one annular sealing surface means associated with said annular means and said closure means for permitting the closure means to slide through said annular sealing surface of said annular member, so as to enable said closure means to have at least three states, in a first state, said closure means cooperates with said annular member for allowing the fluid to pass in a first direction, in a second state, said closure means cooperates with said at least one annular sealing surface for preventing a passage of fluid in a direction opposite to said first direction, and in a third state, said closure means cooperates with said annular member for preventing the fluid from passing in said first direction, and wherein, in the first and second states, said closure means is on the same side in relation to said at least one annular sealing surface, and in said third state, said closure means is on an opposite side, in relation to said at least one annular sealing surface, to the one corresponding to the first and second states, said means for enabling a reversing being adapted to hold the closure means in either one of said first and second states while excluding the third state, or in said third state.

2. The device as claimed in claim 1, wherein said annular member further includes at least one other annular sealing surface, said closure means is adapted to assume at least three positions in the respective first, second and third states, with the first position of said closure means corresponding to said first state, the second position of said closure means corresponding to said second state in which the closure means cooperates with said at least one annular sealing surface, and the third position corresponding to said third state in which said closure means cooperates with said at least one other annular sealing surface.

3. The device as claimed in claim 1, further comprising means for remotely controlling said means for enabling a reversing.

4. The device as claimed in claim 3, wherein said means for remotely controlling includes means associated with said annular member for preventing said closure means from sliding through said at least one annular sealing surface until a predetermined force is applied thereto.

5. The device as claimed in claim 4, further comprising pumping means operatively connected to said duct to provide said predetermined force.

6. The device as claimed in claim 1, wherein said means for enabling a reversing of the movement of said tubular member is adapted to hold the closure means either in said first and second states while excluding the third state, or hold said closure means in said third state while preventing a return of said closure means to said first and second states.

7. The device as claimed in claim 1, further comprising a locking means mounted on said tubular member for releasably locking the tubular member in the duct.

8. The device as claimed in claim 1, wherein said means for enabling reversing of the direction of movement of said tubular member includes an integral part of either one of said closure means and of said annular member.

9. The device as claimed in claim 2, wherein said closure means includes a ball, said annular member having an orifice separating external and internal walls forming said at least one annular sealing surface and said at least one other annular sealing surface for said closure means, said annular member being adapted to be axially displaceable in said tubular element due to an effect of an over pressure, against an action of a return means from said second position, in which said orifice is closed by said closure means, to said third position in which a diameter of said orifice is increased and allows said closure means to pass therethrough.

10. The device as claimed in claim 9, wherein said annular member includes an assembly of coaxial blades adapted to be moved apart from each other so as to increase the diameter of said orifice.

11. The device as claimed in claim 9, wherein an internal wall of said tubular element includes a bearing surface slanting with respect to a longitudinal axis of said tubular element and, wherein an upper portion of said annular member bears against said bearing surface under the action of said return means.

12. The device as claimed in claim 9, wherein said means for enabling a reversing of the direction of movement of the tubular member includes an annular element inserted between said annular member and said return means, said annular element being connected to said tubular element by at least one safety means.

13. A jet pump adapted for being positioned in a duct equipping a well whose production is activated by injecting a drive fluid from a surface of the well into an annular space formed between the duct and a wall of the well, wherein said jet pump includes a device according to any one of the preceding claims so as to allow said jet pump to be positioned from the surface of the well in a working position in the duct and then be recovered therefrom.

14. The device as claimed in claim 1, wherein said tubular element is formed of a plurality of individual tubular pieces connected together by articulations.

15. The device according to claim 12, wherein the safety means includes at least one shear pin.

16. The device according to claim 1, wherein the tubular element includes a guide stop means engageable with said closure means for defining the first position of said closure means in which the closure means cooperates with said annular member to allow the fluid to flow in the first direction.

17. The device according to claim 16, wherein guide means are connected to said closure means for guiding a displacement of the closure means relative to said annular member said guide means being axially displaceable in said guide stop means.

18. The device according to claim 17, further comprising means disposed on said guide means for limiting a displacement of the closure means into said conjugate piece.

19. The device according to claim 18, wherein said guide stop means are disposed in the tubular element at a position above the closure means and said annular member is disposed at a position below the closure means in said first and second states.

20. A jet pump adapted to be positioned in a duct equipping a well whose production is activated by injecting a drive fluid from a surface of the well into an annular space defined between the duct and a wall of the well, wherein said jet pump is equipped with a device for positioning a tool or instrument in a given working position according to one of claims 15, 16, 17, 18, or 19, thereby allowing said jet pump to be positioned from a surface of the well in a working position in the duct and then recovered therefrom.

21. The device as claimed in claim 1, wherein the closure means includes a substantially planar closure member having a longitudinally extending shaft portion connected thereto, and guide stop means are provided in tubular member for axially guiding a displacement of said shaft portion relative to said annular member.

22. The device according to claim 21, wherein said closure means includes a plurality of radially extending blade means.

23. The device according to claim 22, further comprising a stop means on said shaft portion and cooperable with said guide stop means for limiting an axial displacement of said closure means in said tubular element.

24. A device according to claim 23, wherein said guide stop means are disposed in said tubular element at a position below said annular member.

25. A jet pump adapted to be positioned in a duct equipping a well whose production is activated by injecting a drive fluid from a surface of the well into an annular space defined between the duct and a wall of the well, wherein said jet pump is equipped with a device for position a tool or instrument in a given working position according to one of claims 21, 22, 23, or 25, thereby allowing said jet pump to be positioned from a surface of the well in a working position in the duct and then recovered therefrom.

26. A device for positioning a tool or instrument in a given working position inside a duct, then recovering the tool or instrument by causing a fluid to flow though the device, the device comprising a tubular element adapted to be secured to the tool or instrument, and an annular sealing means mounted on said tubular element for sealing engagement with the duct thereby preventing fluid from flowing around said tubular element, means disposed in said tubular element for selecting a direction of movement of the tubular element in the duct, said means for selecting including an annular member disposed in said tubular element, closure means displaceably mounted in said annular member, and means for enabling a reversing of direction of movement of the tubular member, said annular member comprising a least one annular sealing surface, means associated with said annular member and with said closure means for enabling the closure means to slide through said annular sealing surface of said annular member so as to enable said closure means to have at least three states, in a first state, said closure means cooperates with said annular member for allowing the fluid to pass in a first direction, in a second state, said closure means cooperates with said at least one annular sealing surface for preventing a passage of fluid in a direction opposite to said first direction, in a third state, said closure means cooperates with said annular member for preventing the fluid from passing in said first direction, said means for enabling a reversing being adapted to hold said closure means in either of said first and second states while excluding the third state or in said third state.

27. The device as claimed in claim 26, wherein said annular member comprises at least one other annular sealing surface and said closure means has at least three positions, the first position corresponding to said second state in which said closure means cooperates with said at least one annular sealing surface, the third position corresponding to said third state in which said closure means cooperates with said at least one other annular sealing surface.

28. The device as claimed in claim 26, further comprising means for remotely controlling said means for enabling a reversing.

29. The device as claimed in claim 28, wherein said means for remotely controlling includes means associated with said annular member for preventing said closure means from sliding through said at least one annular sealing surface until a predetermined force is applied thereto.

30. The device as claimed in claim 26, wherein said means for enabling a reversing is adapted to hold the closure means in either said first and second states while excluding the third state or said third state while preventing a return of said closure means to said first and second states.

31. The device as claimed in claim 26, further comprising locking means mounted on said tubular member for releasably locking the tubular member in the duct.

32. The device as claimed in claim 26, wherein said means for enabling a reversing of the direction of movement of the tubular member includes an integral part of either one of said closure means and said resilient conjugate piece.

33. The device according to claim 26, wherein the tubular element includes a guide stop means engagable with said closure means for defining the first position of said closure means in which the closure means cooperates with said annular member to allow the fluid to flow in the first direction.

34. The device according to claim 33, wherein guide means are connected to said closure means for guiding a displacement of the closure means relative to said annular member, said guide means being axially displaceable in said guide stop means.

35. The device according to claim 34, further comprising means disposed on said guide means for limiting a displacement of the closure means into said annular member.

36. The device according to claim 35, wherein said guide stop means are disposed in the tubular element at a position above the closure means and said annular member is disposed at a position below the closure means in said first and second states.

37. The device as claimed in claim 26, wherein the closure means includes a substantially planar closure means having a longitudinally extending shaft portion connected thereto, and guide stop means are provided in the tubular member for axially guiding a displacement of said shaft portion relative to said annular member.

38. The device as claimed in claim 37, wherein said closure means includes a plurality of radially extending blade means.

39. The device as claimed in claim 38, further comprising a stop means on said shaft portion and cooperable with said guide stop means for limiting an axial displacement of said closure means in said tubular element.

40. The device as claimed in claim 39, wherein said guide stop means are disposed in said tubular element at a position below said annular member.

41. A jet pump adapted for being positioned in a duct equipping a well whose production is activated by injecting a drive fluid from a surface of the well into an annular space formed between the duct and a wall of the well, wherein said jet pump is equipped with a device for positioning a tool or instrument in a given working position according to any one of claims 26–40, thereby allowing said jet pump to be positioned from a surface of the well in a working position in the duct and then removed therefrom.

* * * * *